US006679182B2

(12) United States Patent
Spieldiener et al.

(10) Patent No.: US 6,679,182 B2
(45) Date of Patent: Jan. 20, 2004

(54) AMUSEMENT DEVICE

(76) Inventors: Patrick Spieldiener, Bildgasse 42, FL-9494 Schaan, Liechtenstein (CH); Reinhold Spieldiener, Im Gafos 25, FL-9494 Schaan, Liechtenstein (CH); Robert Spieldiener, Joseph-Rheinberger-Str. 18, FL-9490 Vaduz, Liechtenstein (CH)

( * ) Notice: Subject to any disclaimer, the term of this patent is extended or adjusted under 35 U.S.C. 154(b) by 0 days.

(21) Appl. No.: 10/220,871

(22) PCT Filed: Mar. 6, 2001

(86) PCT No.: PCT/EP01/02502

§ 371 (c)(1),
(2), (4) Date: Sep. 5, 2002

(87) PCT Pub. No.: WO01/66210

PCT Pub. Date: Sep. 13, 2001

(65) Prior Publication Data

US 2003/0019388 A1 Jan. 30, 2003

(30) Foreign Application Priority Data

Mar. 8, 2000 (DE) ..... 200 03 950 U

(51) Int. Cl.[7] ..... A63G 21/00
(52) U.S. Cl. ..... 104/53; 104/63; 104/173.1
(58) Field of Search ..... 104/53, 55, 63, 104/173.1; 418/61.3

(56) References Cited

U.S. PATENT DOCUMENTS

| | | | | | |
|---|---|---|---|---|---|
| 1,633,204 | A | | 6/1927 | Bartlett | 104/53 |
| 1,805,266 | A | | 5/1931 | Traver | 104/53 |
| 1,823,010 | A | | 9/1931 | Traver | 104/53 |
| 4,165,695 | A | * | 8/1979 | Schwarzkopf | 104/55 |
| 4,534,451 | A | * | 8/1985 | Peter | 187/245 |
| 5,114,324 | A | * | 5/1992 | Spindeldreher | 418/61.3 |
| 5,167,291 | A | * | 12/1992 | Mann | 180/6.3 |
| 5,791,254 | A | * | 8/1998 | Mares et al. | 104/53 |
| 6,176,788 | B1 | * | 1/2001 | Checketts | 104/138.1 |
| 6,397,755 | B1 | * | 6/2002 | Kamler | 104/53 |
| 6,397,756 | B1 | * | 6/2002 | Saiko et al. | 104/53 |
| 6,439,129 | B2 | * | 8/2002 | Begotti | 104/63 |

FOREIGN PATENT DOCUMENTS

| | | |
|---|---|---|
| DE | 177794 | 10/1905 |
| DE | 28 32 991 | 2/1980 |
| DE | 42 43 812 | 6/1994 |
| DE | 44 25 107 | 1/1996 |
| DE | 298 22 644 | 11/1999 |
| DE | 200 04 662 | 6/2000 |
| FR | 366 258 | 10/1906 |
| WO | WO 98/45007 | 10/1998 |

* cited by examiner

*Primary Examiner*—S. Joseph Morano
*Assistant Examiner*—Lars A. Olson
(74) *Attorney, Agent, or Firm*—McGlew and Tuttle, P.C.

(57) ABSTRACT

An amusement device (1) has one or several vehicles (2). The drive device (13) of the vehicles is configured as a high-performance catapult drive (22) which is provided with one or more hydromotors (24) and a traction mechanism (20) that has to be detachably connected to the vehicle (2) by means of a carrying device (14). The catapult drive is designed as a rotary drive or winding drive.

18 Claims, 5 Drawing Sheets

AMUSEMENT DEVICE

FIELD OF THE INVENTION

The present invention pertains to an amusement facility with one or more vehicles and a catapult drive for the vehicles.

BACKGROUND OF THE INVENTION

Such an amusement facility with a catapult drive has been known from FR-A 366 258. A vehicle is moved here at a high velocity along a track curved in space and shall return into the starting position at the end in free flight. The catapult drive comprises a plurality of springs, which are placed in pipes and are connected to a carrier.

A similar catapult drive with drive springs is shown in DE-C 177 794. The catapult drive acts on a rail-borne vehicle and moves same upward along an oblique ramp. The vehicle returns into the starting position on the same path. The springs are tensioned by means of a chain drive. In addition, a braking means is also present, which works against the springs at the beginning of the acceleration section and diminishes the acceleration acting on the passengers.

WO 98/45007 likewise pertains to an amusement facility, in which passenger carriers are moved to and fro on a rail track. Besides a conventional chain drive, a catapult drive, which is not described specifically and is also not shown, may be used as the drive.

Another amusement facility with a catapult drive has been known from DE-A 27 03 833. The catapult drive comprises a cable or chain guided endlessly with a connected accelerating carriage for the passenger carrier and is operated with a falling weight as a pushing drive. As an alternative to the falling weight, a stationary linear pushing drive, which may be designed as a linear motor or as a hydraulic lifting cylinder with a reduced ratio, may be used in the area of the starting section.

Finally, another catapult of the type of an ejection seat, in which the seat is pivoted by means of a pivoting lever, has been known from DE-A 44 25 107. The drive is not described specifically.

Another amusement facility in the manner of a roller coaster has been known from DE-A 28 32 991 and DE-U 298 22 644. Immediately after leaving the boarding point, the vehicles are towed with a drive means, which is designed as an endless chain drive, to the highest elevation of the roller coaster over an ascending section and are released there. The chain drive is relatively slow and it pulls the vehicle leisurely upward.

In chain mechanisms, the towing force is transmitted via a sprocket wheel engaging the chain in a positive-locking manner. The polygon effect generated in the process leads to high stresses and to noise. In addition, lubrication of the chain is necessary, which leads to problems with dripping and to difficulties in disposal. Due to the heavy weight, the field of use is limited to short distances and to low velocities in the range of up to about 5 m/sec. The endless chain drives have carriers, which engage the vehicles of the amusement facility.

SUMMARY AND OBJECTS OF THE INVENTION

The object of the present invention is to improve the prior-art amusement facility.

This object is accomplished by the present invention with an amusement facility with one or more vehicles and a drive means for the vehicles wherein the drive means is designed as a catapult drive. The catapult drive has one or more hydromotors.

The drive means is designed in the amusement facility as a catapult drive, which drives one or more vehicles at a high acceleration and velocity from standing or slow travel and launches them preferably into a free travel section. This high initial acceleration and velocity offers a new attraction and experience for roller coasters, but also for other types of rides.

Extremely high driving forces or driving torques can thus be transmitted and high accelerations can be reached, so that the vehicles can reach velocities in excess of 50 m/sec and accelerations exceeding 2 g within a few seconds. The moving masses of the vehicle and the passengers may vary between a few hundred kg and several tons.

The catapult drive is suitable for all types of amusement facilities. Special advantages arise for roller coasters and other similar types of rides.

Hydromotors are used as drive motors. They have the advantage that they are able to make available the enormous accelerating energy of several MW, which is necessary for a short time. The accelerating energy can, furthermore, be buffered between the starts taking place at regular intervals by means of storage units. Contrary to direct drives, the installed power can thus be drastically reduced. In addition, the hydromotor has the advantage of having an especially small size and small inertia of masses. Moreover, it is far superior to a pneumatic drive in terms of efficiency, energy loss and noise emission.

The catapult drive may be designed as an endless drive or as a winding or winch drive. A winding drive has some special advantages. Due to the positive-locking connection of the drive or winding drum to the pulling means, friction effects and friction dependencies can be eliminated. The wrapping angle and the pretensioning forces can be lower than in the case of a friction drive, and the pulling means, preferably one or more pulling cables, are also spared more and last longer. A multiple cable arrangement makes it possible for the individual pulling cables to have a smaller cross section. This results in a smaller drum diameter, which further increases the effectiveness of the catapult drive.

It is, furthermore, recommended that a carrying means and especially a towing car, which engages the vehicle to be accelerated with a movable carrier hook, be fastened to the pulling means. The preferred embodiment offers special advantages in terms of a simple design and operational safety.

The pulling means may have different designs. Instead of a chain, it is possible to use a cable or belt, which are better suited for the extremely high accelerations and velocities as well as the loads resulting therefrom. A multiple cable arrangement or a broad-area pulling means, which preferably comprises a plurality of cable strands located in parallel next to one another and are optionally connected to one another, or a belt, is advantageous, but another design is also possible as an alternative. The pulling means comprises a material suitable for the high load.

The pulling means has the advantage over a chain in that the need for lubrication can be eliminated, as a result of which the towing forces can be transmitted with a correspondingly higher coefficient of friction in the case of a friction drive. This leads, furthermore, to a substantial reduction in the pretensioning force. In addition, the pulling means can pass over one or more drive and deflecting rollers without a substantial reduction of the service life.

The pulling means has, furthermore, the advantage of having a lower price, lower noise emission, lower weight as well as lower inertia of masses. The handling and maintenance are facilitated and improved. Favorable effects are also obtained for disposal and environmental friendliness. Furthermore, the small possible bending radius, the high fatigue strength under reversed bending stresses and the high reliability of operation are advantages as well.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
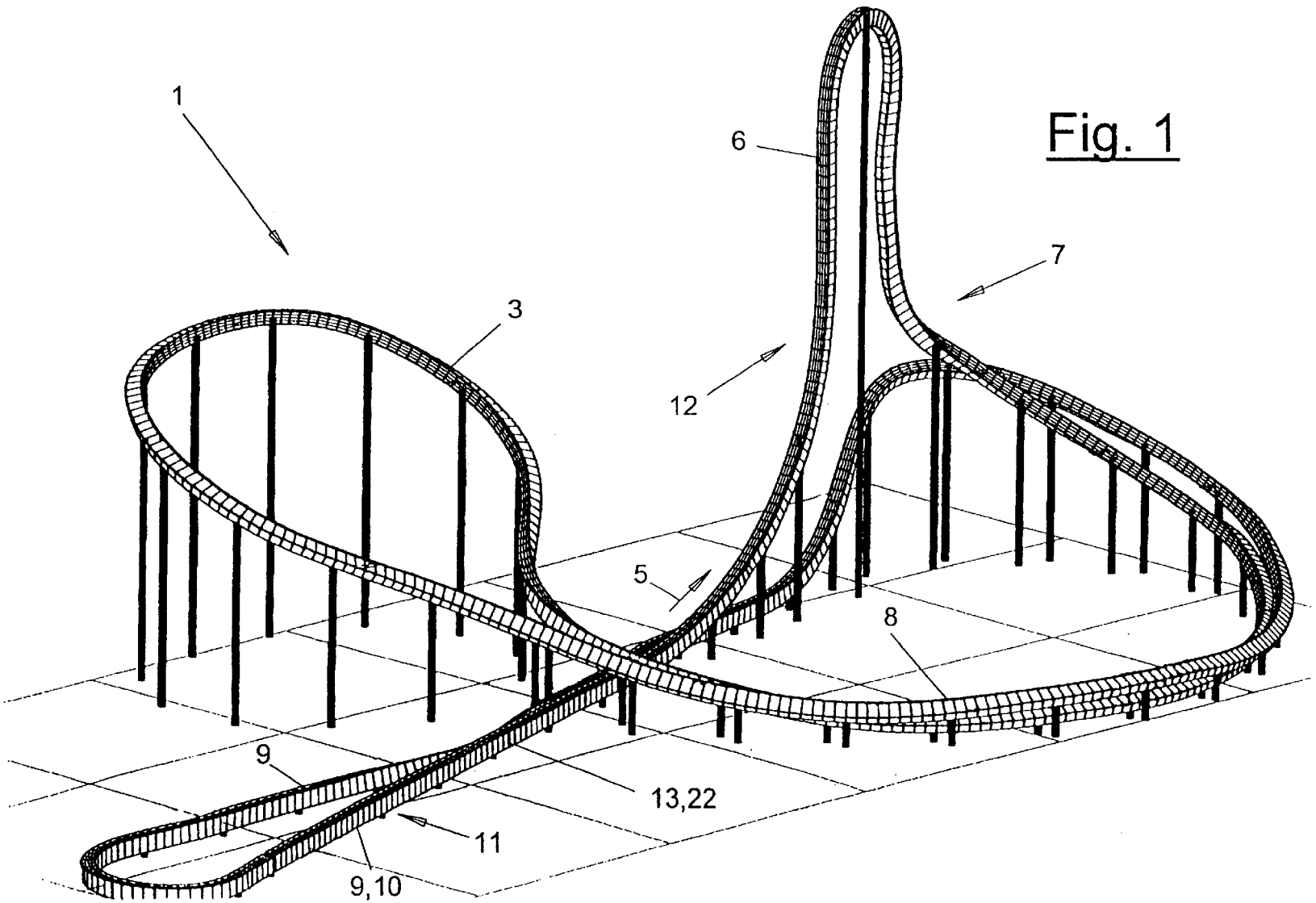
FIG. 1 is an amusement facility of the roller coaster type with a drive means for the vehicles.
Figure 2:
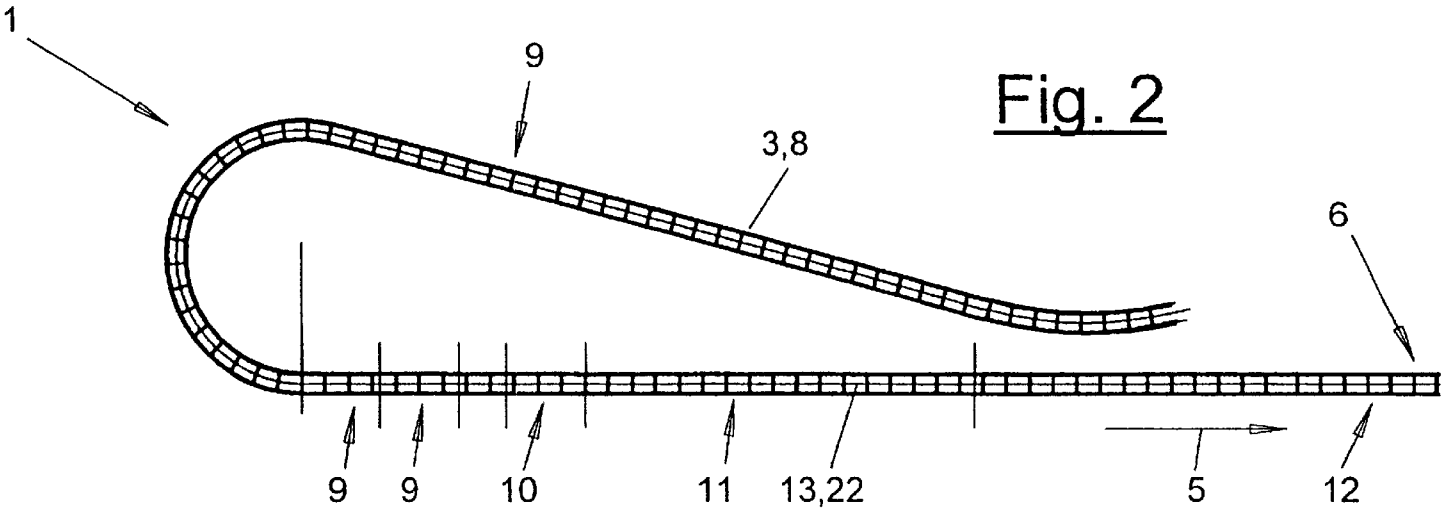
FIG. 2 is a top view of a part of the amusement facility with the acceleration section and the drive section with the drive means.
Figure 3:
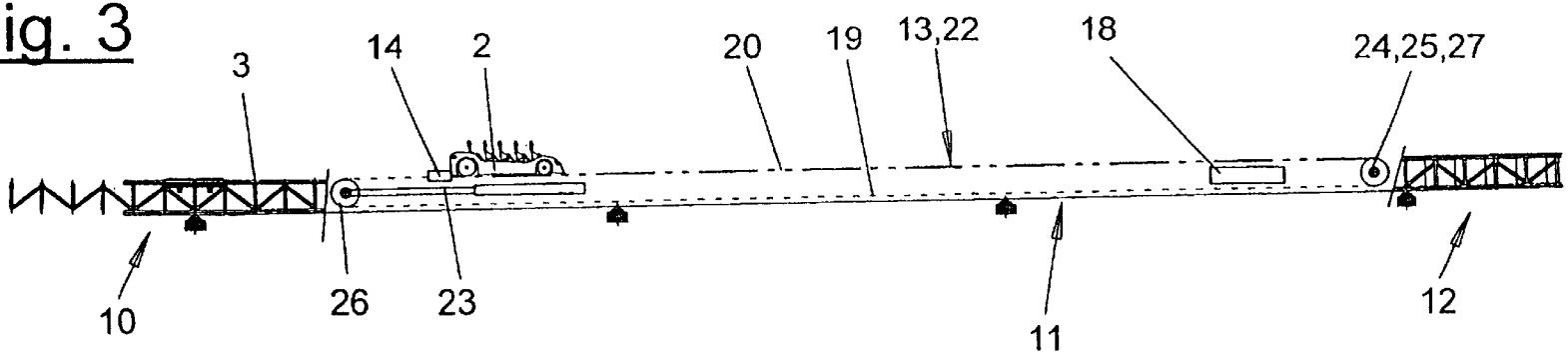
FIG. 3 is a partially simplified and schematized side view of the acceleration section with the drive means.

Referring to the drawings in particular, FIG. 1 shows an amusement facility 1, which is designed as a ride, e.g., as a roller coaster. It comprises a rail-like guide 3 for one or more vehicles 2, which are set into motion by means of a drive means 13. The drive means 13 drives the vehicles 2 along an acceleration section 11, accelerates them in the process to the desired initial velocity, and releases them at the end of the acceleration section 11. FIGS. 2 and 3 show the acceleration section 11 and the drive means 13 located there in a simplified and broken-away view.

The vehicles 2 separated from the drive means 13 will then move on a freely selected free travel section 12 based on their kinetic energy. The travel section may be finite or endless. It may have elevations, valleys, curves, slopes, loopings, plunge sections or any other layout. In the embodiment being shown, the vehicles 2 are first catapulted by the drive means 13 to a tower-like elevation 6 in a steep ascending section after a start-up section, and the vehicles return from the zenith of the elevation 6 to their starting point in a slope section 7 with subsequent travel sections 8 in a roller coaster travel. As an alternative, the vehicles 2 may also be catapulted in a looping or another path section.

Figure 4:
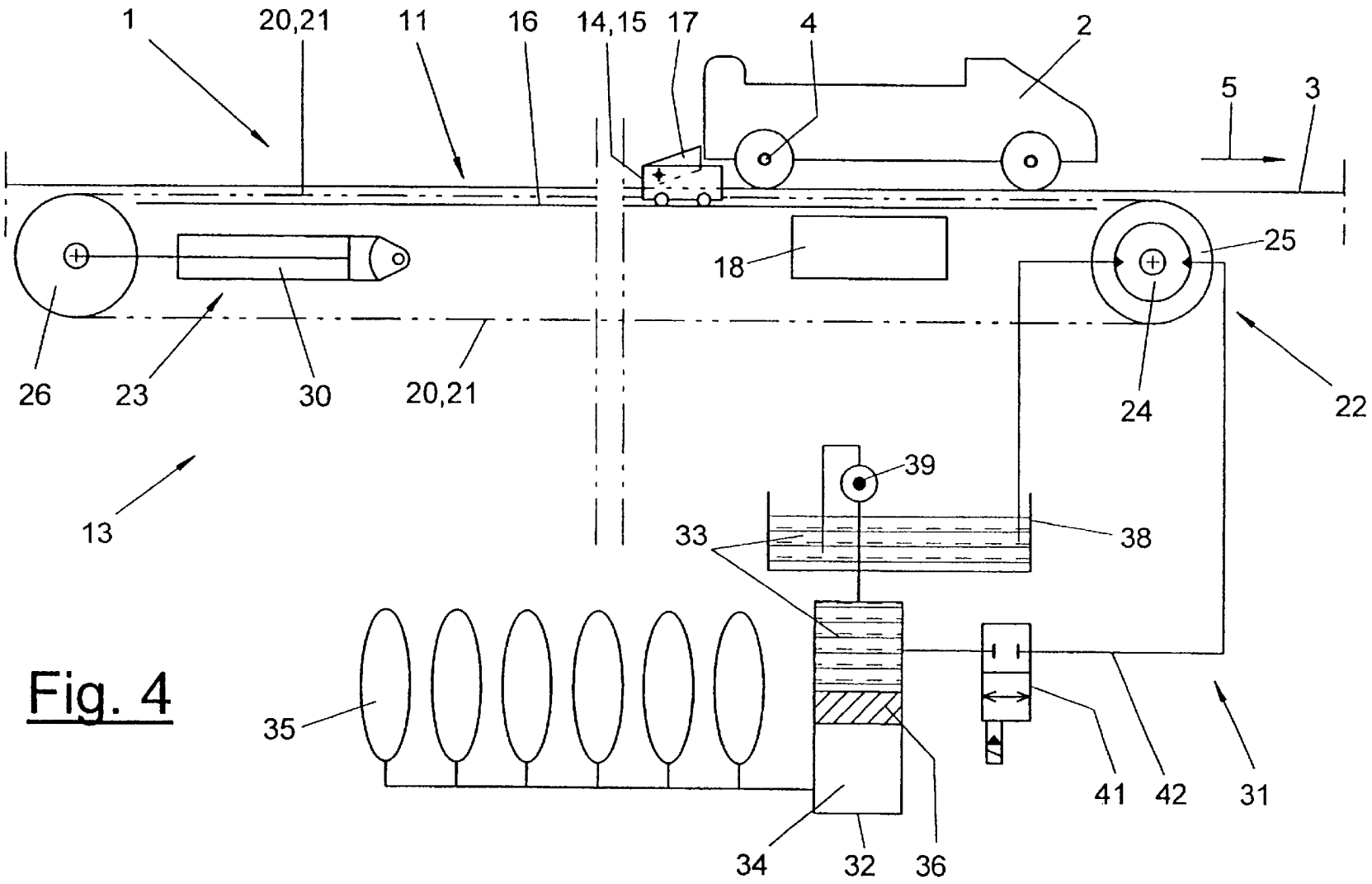
FIG. 4 is a schematic and broken-away view of a drive means with endless pulling means and a hydraulic supply.
Figure 5:
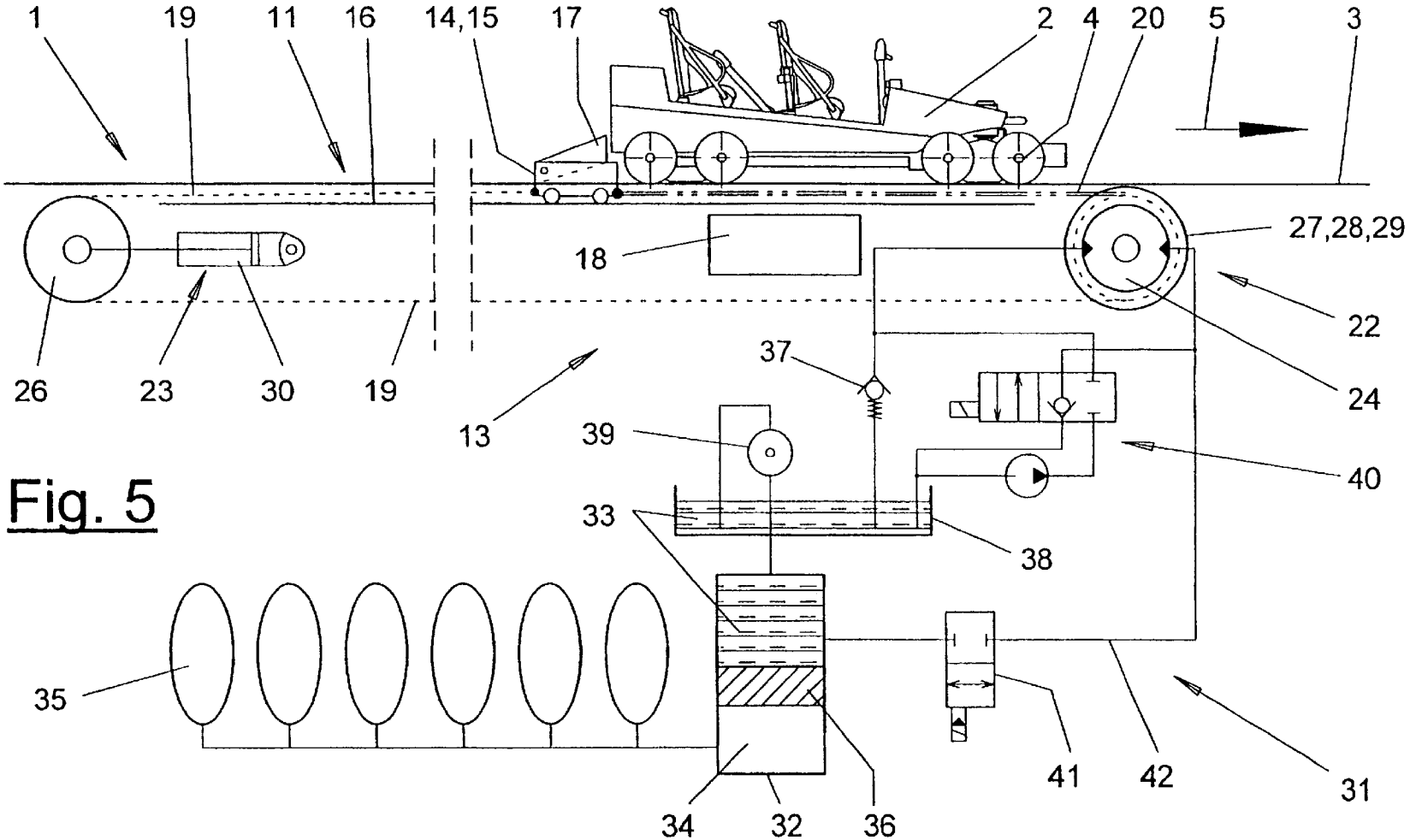
FIG. 5 is a variant of the drive means according to FIG. 4 with a windable pulling means and a hydraulic supply.

The drive means 13 is present as a single drive means in the preferred embodiment. However, multiple drive means may also be present in larger facilities and ensure the intermediate acceleration of the cars. The amusement facility 1 also has, furthermore, one or more braking sections 9. It has, moreover, a boarding area 10, which is optionally also preceded by a resting or waiting section. The amusement facility 1 may also have a plurality of elevations. It may have any desired layout. For clarity's sake, only the acceleration section 11 of the amusement facility 1 with the drive means broken off and shortened is shown in FIGS. 4 and 5.

In the embodiment being shown, the vehicles 2 move on a guide 3 along the travel section, which is designed, e.g., as a closed track. The travel section is designed as a rail structure and has, e.g., a suitable cross-sectional profile with a suitable number of running rails and optionally also support rails. The vehicles 2 roll with a suitable chassis 4 on the guide 3. The guide 3 may otherwise also have any other desired design, e.g., it may also be designed as a monorail guide for vehicles 2 suspended overhead.

The drive means 13 is designed in the preferred embodiment being shown as a highly dynamic catapult or throwing drive 22, which accelerates the cars to a launch velocity of about 150 km/hour or more within a few seconds. In the embodiment being shown, the acceleration or drive section 11 is located at a spaced location in front of the first elevation 6 and is located in an essentially horizontal or preferably only relatively weakly sloping starting area.

The drive means 13 has a reversible design in the embodiment being shown and operates intermittently. It drives the vehicles 2 by pushing or pulling in the direction of travel 5 in one direction and detachably and launches them. After the separation of the vehicles 2, it returns into its starting position at the point of boarding 10.

The drive means 13 has a pulling means 20 with a carrying means 14 for the vehicles 2. The catapult drive 22 drives the pulling means 20 with one or more motors 24. The pulling means 20 and optionally a tensioning cable 19 are pretensioned by means of a cable tensioner 23 and their strands are held permanently under tensile stress.

Figure 6:
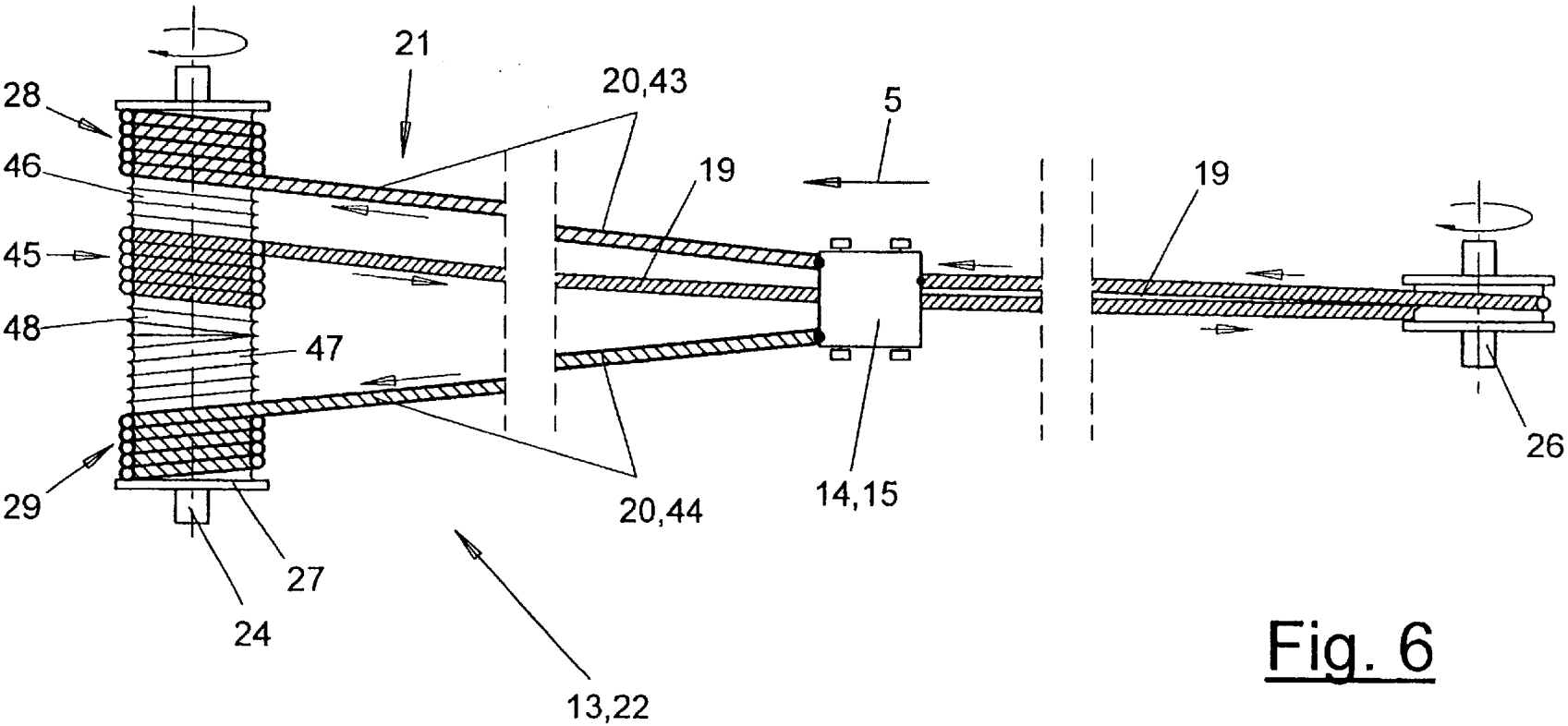
FIG. 6 is a top view of the winding drive according to FIG. 5.

FIG. 4 and FIGS. 5 and 6 show two different embodiments of the catapult drive 22. It is designed as an endless drive in FIG. 4 and as a winding drive in FIGS. 5 and 6.

In the variant according to FIG. 4, the pulling means 20 is led in a closed loop along the acceleration section 11 and is fastened with its two ends to the carrying means 14. The pulling means 20 is led in a single loop over two end-side driving and deflecting rollers 25, 26. As an alternative, a plurality of driving and deflecting rollers 25, 26 may be present as well. The catapult drive 22 is designed, e.g., as a friction drive.

In the embodiment according to FIG. 4, the broad-area pulling means 20 is designed as an elastic multiple cable array 21, which is formed by a plurality of preferably single-layer, thin cable strands or strands located in parallel next to one another. The cable strands may be connected to one another to form a one-part pulling means 20. As an alternative, the cable strands may also be located loosely next to one another. The cable strands may consist of steel or a plastic with high load-bearing capacity and do not need to be lubricated. They may also have a suitable jacketing. The ratio of the thickness of the cable or strand to the width of the pulling means 20 may be preferably between about 1:10 and 1:30 or higher to obtain the desired broad area. The cable strands may run over guide means of a corresponding shape with grooves or the like.

In an alternative embodiment, not shown, the pulling means 20 may also comprise a plurality of belts or other similar strands, running in parallel. In another variant, the pulling means 20 may be designed as a belt, which has a high tensile strength in conjunction with a high fatigue strength under reversed bending stresses and a surface that is favorable with respect to friction. In one variant, the belt 21 may also have a transversely and/or longitudinally profiled surface, e.g., in the form of a toothed belt. Furthermore, it is possible to arrange a plurality of belts next to one another.

As is indicated in FIG. 3, the drive means 13 is integrated within the running rail 3 and is located within the rail structure. The inner area of the latter and the drive means 13 are accessible from the outside. The motor 24 of the catapult drive 22 is located at the front end of the acceleration section 11 in the direction of travel 5, and the cable tensioner 23 is located at the rear end. This arrangement may also be reversed as an alternative or be designed differently in another way. The pulling means 20 extends along and preferably extensively within the running rail 3.

The carrying means 14 may have different designs. Because of the ability of the pulling means 20, it is provided with a guide 16 of its own, which is located within the running rail 3. It comprises, e.g., a centrally arranged rail with two C profiles, which face each other with their openings and are arranged at laterally spaced locations from the center. The guide 16 extends essentially over the length of the acceleration section 11. The carrying means 14 comprises a towing car 15, which can travel in the guide 16 and to which the ends of the pulling means 20 are fastened. The towing car 15 has a suitable carrying means 17, which engages the vehicle 2 in a positive-locking or frictionally engaged manner and transmits the driving forces generated by the catapult drive 22 to the vehicle 2, while pulling or pushing the vehicle 2.

In the preferred embodiment, the carrying means 17 comprises a movable catch, which can be pivoted up and down by means of a pivot bearing. In the raised docking position, which is shown in FIG. 4, the catch 17 engages the vehicle 2 in a positive-locking manner. In the lowered inoperative position, the vehicle 2 can run over the catch 17. The raising and lowering of the catch 17 can be performed in any desired, suitable manner. A suitable connecting link, which extends under the catch 17 during the reverse travel of the vehicle 2 and raises same into the docking position, may be present at the vehicle 2. The catch 17 drops back automatically into the inoperative position under the force of gravity at the end of the acceleration section 11 after the vehicle 2 has been launched.

The carrying means 14 may have, moreover, a suitable braking means 18, which actively brakes it at the end of the acceleration section 11. This braking means 18 may have any desired, suitable design. As an alternative or in addition, braking may also be performed by means of the catapult drive 22.

At the end of the acceleration section 11, the accelerated vehicle 2 becomes detached from the braked carrying means 14, which will then stop and subsequently move slowly back into the starting position at the beginning of the acceleration section 11. The catch 17 is now lowered into the inoperative position. After passing over the travel section, the vehicle 2 returns into the starting position, running over the towing car 15 standing ready. The vehicle 2 is then moved back into the definitive start position by a return means, not shown, e.g., an array of a plurality of friction wheels, and the vehicle extends now under the catch 17 with its connecting link and raises it into the docking position. There is a positive-locking connection, which is loadable in the direction of travel 5, between the carrying means 14 and the vehicle 2 in this position. The friction wheels can then again be deactivated and removed from the range of travel of the vehicle 2. A plurality of vehicles 2 may also be under way in different track sections at the same time on the amusement facility 1.

The cable tensioner 23 is schematically shown in FIG. 4. In the preferred embodiment, it comprises one or more suitable tensioning drives 30, which move the deflecting roller 26. The tensioning drive 30 applies a pulling and tensioning force on the belt loop via the deflecting roller 26 and tightens both strands of the pulling means 20. The deflecting roller 26 moves opposite the direction of travel 5 for tensioning.

The catapult drive 22 is accommodated in a compact housing inside the running rail 3. It has at least one drive roller 25 and at least one motor 24. In the exemplary embodiment of a highly dynamic hydromotor shown, one drive roller 25 is present, to which one or more hydromotors 24 can be attached on both sides via a suitable transmission arrangement not shown and they together drive the drive roller 25. Pressure is admitted to the hydromotors 24 from a hydraulic supply 31.

The above-described catapult or hydraulic drive 22 and the hydraulic supply 31 can also be used successfully for other types of towing or travel drives as well as for other towing means. The hydraulic supply 31 offers an especially dynamic and high power in conjunction with the multiple arrangement of hydromotors 24.

The hydraulic supply 31 has at least one hydraulic storage unit 32, which is designed as a piston-type storage unit in the embodiment being shown. As an alternative, it may also have any other design, e.g., it may be a bubble storage unit or a spring-type storage unit. The separating piston 36 moves axially to and fro in the storage or cylinder space and separates the hydraulic fluid 33, which is preferably a hydraulic oil, and a compressible storage fluid 34, e.g., a gas, preferably nitrogen, from one another. The gas chamber in the hydraulic storage unit 32 is connected to an external gas pressure storage unit 35, which is designed, e.g., as a battery of containers.

The hydraulic supply 31 also has, furthermore, at least one storage reservoir 38, e.g., a tank, for the hydraulic fluid 33. One or more pumps 39, e.g., charge pumps, deliver the hydraulic fluid 33 from the storage reservoir 38 back into the hydraulic storage unit 32. The hydraulic supply 31 also includes, furthermore, a network of lines 42 and valves 41, via which the hydraulic fluid 33 is sent to the hydromotor or hydromotors 24.

For using the hydraulic supply 31, the hydraulic storage unit 32 is filled with the hydraulic fluid 33 by means of one or more pumps 39, the stored fluid 34 is greatly compressed by means of the separating piston 36 and pre-pressurized. The connection lines to the hydromotor or hydromotors 24 are closed by the valves 41 at this point in time. To actuate the catapult drive 22, the lines 42 to the hydromotor or hydromotors 24 are opened. The pre-pressurized stored fluid 34 expands and expels the hydraulic fluid 33 from the hydraulic storage unit 32 to the hydromotor or hydromotors 24 by means of the separating piston 36, and the hydromotor or hydromotors 24, being rotating drives with blade wheels or other similar guide organs, convert the flow energy into a rotary movement of the drive rollers 25 and drive the pulling means 20 in the direction of travel 5 with a strong force and acceleration. After flowing through the hydromotors 24, the hydraulic fluid 33 flows back into the storage reservoir 38.

As soon as the gas pressure of the stored fluid 34 has dropped to a predetermined value or the vehicle 2 has reached a desired velocity of travel, which is measured and signaled by a suitable measuring means (not shown), e.g., at the running rail 3 or at the hydromotor or hydromotors 24, the catapult drive 22 is switched over to idle. The vehicle 2 is at the end of the acceleration section 11 at this stage. The carrying means 14 is then braked by the braking means 18 together with the connected pulling means 20 and the hydromotor or hydromotors 24. The vehicle 2 now becomes detached from the carrying means 14 and continues to move on the free travel section 12 because of its preserved kinetic energy.

The catapult drive 22 is then switched over again, and hydromotors 24 driven in the opposite direction move the pulling means 20 with the towing car 15 back into the starting position at the boarding point 10. FIG. 5 shows a reversing cycle 40, which is used for this, with a nonreturn valve 37 in the line between the hydromotors 24 and the tank 38. The hydraulic storage unit 32 is again pressurized at the end of the return travel of the catapult drive 22 and is ready for the next ride.

FIGS. 5 and 6 show a variant of the catapult drive 22, which is designed as a winding drive or cable winch drive. The pulling means 20 is again designed as a multiple cable array 21 and comprises, e.g., two pulling cables 43, 44, which are fastened to the front side of the catch car 15 in the direction of travel 5. The two pulling cables 43, 44 are attached and wound on a winding drum or cable drum 27. The cable drum 27 has an essentially horizontal axis of rotation and is driven by one or more hydromotors 24 in a reversing manner. Two separate winding areas 28, 29, which are located at spaced locations from one another, are present here at the end areas of the cable drum 27 for the correspondingly spread-apart pulling cables 43, 44. The winding areas 28, 29 have a suitable groove or cable guide 46, 47, e.g., on the jacket of the drum, for accurately placing the pulling cables 43, 44. Helical groove guides 46, 47, one of which, 46, is left-handed and the other, 47, is right-handed in the driving direction shown in FIG. 6, are present in the embodiment being shown. The spread-apart pulling cables 43, 44 are wound up as a result from the outer sides toward the center during the rotation of the drum in the driving direction.

The catapult drive 22 also has, furthermore, a tensioning cable 19 in this embodiment, which is attached on the rear side of the catch car 15. The tensioning cable 19 is led over the above-mentioned spaced-apart deflecting roller 26 and back under and through the catch car 15 to the cable drum 27 and is likewise attached with the other end to the cable drum 27 and wound up. The direction of winding of the tensioning cable 19 is opposite the winding direction of the pulling cables 43, 44.

The tensioning cable 19 has a winding area 45 of its own with a groove guide 48 on the cable drum 27, which is located between the winding areas 28, 29 of the pulling cables 43, 44. The groove guide 48 of the tensioning cable 19 has the same left-handed helical shape, size and pitch as the groove guide 46 of one pulling cable 43, the two groove guides 46,48 passing over into one another. A common winding area 28, 45 is obtained as a result for the two cables 19, 43.

The winding direction of the tensioning cable 19 is opposite the winding direction of the pulling cables 43, 44. When the pulling cables 43, 44, arriving on the top side of the drum, are wound up during the rotation of the drive of the cable drum 27 in the direction of travel 5, the tensioning cable 19 is correspondingly wound off from the underside of the drum. Due to the opposite winding directions, the tensioning cable winding decreases to the same extent by which the pulling cable winding broadens and it yields space to the pulling cable winding. The movement is reversed in the reversing operation.

The hydromotor or hydromotors 24 and the cable drum 27 are likewise at the end of the acceleration section 11 that is the front end in the direction of travel 5 in this embodiment of the catapult drive 22. The deflecting roller 26 is arranged on the other side at the rear end of the acceleration section 11. In the start position of the vehicle 2 and of the catch car 15, the pulling cables 43, 44 are wound off completely or at least almost completely. The tensioning cable 19 is, by contrast, wound up completely or nearly completely. The catapult drive 22 will then rotate the cable drum 27 at a high velocity by means of the hydromotor or hydromotors 24. As a result, the pulling cables 43, 44 are wound up and they pull the catch car 15 in the direction of travel. At the same time, the tensioning cable 19 is wound off and is fed via the deflecting roller 26 corresponding to the movement of the car.

The catapult drive 22 is braked at the end of the drive or acceleration section 11 in the above-described manner and the hydromotor or hydromotors 24 are switched over to idle. During the subsequent reversing operation, the hydromotor or hydromotors 24 rotate the cable drum 27 in the opposite direction and the tensioning cable 19 is again wound up and it pulls back the catch car 15 into the start position as a result. The pulling cables 43, 44 wound off from the cable drum 27 are dragged at the same time by the catch car 15. The cable tensioner 23 acting on the deflecting roller 26 always keeps the pulling and tensioning cables 43, 44, 19 under a predetermined tensile stress.

Various modifications of the embodiment shown are possible. On the one hand, the pulling means 20 may have any other desired, suitable design. Furthermore, the catapult drive 22 may have any other desired number and arrangement of driving and deflecting rollers 25, 26 and motors 24. In the endless drive according to FIG. 4, a toothed belt drive or the like with positive-locking power transmission is also possible instead of a friction drive with non-positive power transmission. The drive means 13 may also be designed as a continuous drive with a short acceleration phase and a subsequent, extensively constant velocity phase. In the design as a hydraulic drive, the hydromotors 24 may also be coupled with another type of hydraulic supply 31.

In the exemplary embodiment of an endless drive shown in FIG. 4, the pulling means 20 is guided and driven in a loop. The catapult drive 22 and the movement of the pulling means are reversible and they alternatingly perform a forward movement and a reverse movement. However, the endless drive may also drive the pulling means 20 continuously and in a constant direction of movement in a variant which is not shown.

As an alternative, a plurality of cable drums 27 may be present in the winding drive according to FIGS. 5 and 6, and a separate winding drum 27 may also be provided for each pulling and tensioning cable 43, 44, 19. In addition, the number of the pulling and tensioning cables 43, 44, 19 may be varied as desired and it may be lower or greater than in the exemplary embodiment being shown. The design embodiment and the arrangement of the cable guide 46, 47, 48, which may comprise, e.g., upstream guide elements traveling along the drum during its rotation, are also variable. Other winding drives and winding elements may also be used instead of a winding or cable drum 27 with horizontal axis of rotation.

Furthermore, the connection between the pulling means 20 and the catapult drive 22 is also variable. The carrying means 14 is detachable in the embodiment shown and acts in one direction on the vehicle 2. In one variant, which is not shown, it is possible to permanently connect the carrying means 14 to the vehicle 2 and to return the vehicle 2 into the starting position in the reversing operation together with the carrying means 14. Such a design is suitable, e.g., for fall frames, in which the vehicle 2 is moved upward with the drive means 13 on a vertical or oblique frame and is then let fall after switching off the catapult drive 22 and is moved downward by its own weight. As an alternative, the catapult drive 22 may also act on the vehicle 2 in the reversing operation during the downward movement. In another variant, it is possible to do away with the additional carrying means 14 and to fasten the pulling means 20 to the vehicle 2. There is direct drive by the catapult drive 22 in the reversing or endless operation in this case.

In addition, the amusement facility 1 may have any other desired, suitable design and have other types of vehicles and guides or sections for the vehicles.

While specific embodiments of the invention have been shown and described in detail to illustrate the application of the principles of the invention, it will be understood that the invention may be embodied otherwise without departing from such principles.

What is claimed is:

1. An amusement facility, comprising:

one or more vehicles; and a drive means for driving the vehicles, the drive means comprising a catapult drive with one or more hydromotors with rotating drive, said catapult drive having a guided carrying means for detachable or permanent connection to said one or more vehicles and said catapult drive having at least one pulling cable and a tensioning cable, which are fastened to said carrying means at opposite points, said catapult drive having a winding drive with a cable drum, said pulling cable being wound on said cable drum with said cable drum rotatingly driven by said one or more hydromotors.

2. An amusement facility in accordance with claim 1, wherein said catapult drive is a high-power drive for high accelerations and velocities of travel of said one or more vehicles.

3. An amusement facility in accordance with claim 1, wherein said catapult drive has a hydraulic supply with a hydraulic storage unit which can be pressurized, a line and valve array, a storage reservoir and one or more pumps.

4. An amusement facility in accordance with claim 3, wherein said hydraulic storage unit includes a piston-type storage unit, which is connected on a gas side to an external gas pressure storage unit.

5. An amusement facility in accordance with claim 3, wherein said hydraulic storage unit is designed as a bubble storage unit or as a spring-type storage unit.

6. An amusement facility in accordance with claim 1, wherein said pulling cable is a flexible multiple cable array that can be subjected to tensile load with a plurality of cable strands.

7. An amusement facility in accordance with claim 1, wherein said catapult drive is a reversible drive.

8. An amusement facility in accordance with claim 1, wherein said pulling cable has two cable strands.

9. An amusement facility in accordance with claim 1, wherein said cable drum is a common, driven cable drum with separate winding areas for two pulling cables and a tensioning cable, wherein said pulling cables and said tensioning cable have opposite directions of winding and said tensioning cable is guided over a spaced-apart deflecting roller.

10. An amusement facility in accordance with claim 9, wherein said winding areas of said pulling cables have groove guides with a helical shape extending in opposite directions.

11. An amusement facility in accordance with claim 9, wherein said winding area of said tensioning cable has a groove guide, which corresponds in terms of shape and pitch to an adjacent groove guide of a pulling cable and passes over into same.

12. An amusement facility in accordance with claim 1, further comprising a braking means provided for said carrying means.

13. An amusement facility in accordance with claim 1, wherein said carrying means has a towing car with a mobile catch, which can be brought by a rearward connecting link at said vehicle into a raised docking position and falls into a lowered inoperative position under the force of gravity after the separation of said vehicle.

14. An amusement facility in accordance with claim 1, wherein said catapult drive tensioning cable is connected to a cable tensioner with a tensioning drive.

15. An amusement facility in accordance with claim 1, wherein said tensioning cable is wound on said cable drum along with said pulling cable.

16. An amusement facility, comprising:

one or more vehicles; and a drive means for driving the vehicles, the drive means comprising a catapult drive with one or more hydromotors with rotating drive, said catapult drive having a common, driven cable drum with separate winding areas for two pulling cables and a tensioning cable, wherein said pulling cables and said tensioning cable have opposite directions of winding and said tensioning cable is guided over a spaced-apart deflecting roller.

17. An amusement facility in accordance with claim 16, wherein said catapult drive has a guided carrying means for detachable or permanent connection to said one or more vehicles.

18. An amusement facility, comprising:

one or more vehicles; and a drive means for driving the vehicles, the drive means comprising a catapult drive with one or more hydromotors with rotating drive, wherein said catapult drive has a hydraulic supply with a hydraulic storage unit which can be pressurized, a line and valve array, a storage reservoir and one or more pumps.

* * * * *